US006557798B1

(12) United States Patent
Giesenberg et al.

(10) Patent No.: US 6,557,798 B1
(45) Date of Patent: May 6, 2003

(54) MISSILE

(75) Inventors: Peter Joachim Wilhelm Giesenberg, Salem (DE); Otto-Paul Jakob, Uberlingen (DE)

(73) Assignee: Bodenseewerk Geratetechnik GmbH, Uberlingen/Bodensee (DE)

( * ) Notice: Subject to any disclaimer, the term of this patent is extended or adjusted under 35 U.S.C. 154(b) by 0 days.

(21) Appl. No.: 07/540,922

(22) Filed: May 23, 1990

(30) Foreign Application Priority Data

May 23, 1989 (DE) ..... 39 16 690

(51) Int. Cl.[7] ..... F42B 10/02
(52) U.S. Cl. ..... 244/3.29; 244/3.27; 244/3.28
(58) Field of Search ..... 244/3.27, 3.28, 244/3.29, 49

(56) References Cited

U.S. PATENT DOCUMENTS 2,923,241 A * 2/1960 House ..... 244/3.29
3,633,846 A * 1/1972 Biggs, Jr. ..... 244/3.27
4,364,531 A * 12/1982 Knoski ..... 244/3.27
4,667,899 A * 5/1987 Wedertz ..... 244/3.29
4,736,909 A * 4/1988 Böder et al. ..... 244/3.29

FOREIGN PATENT DOCUMENTS

GB 2059023 * 4/1981 ..... 244/3.28
GB 1597351 * 9/1981 ..... 244/3.28

* cited by examiner

*Primary Examiner*—Michael J. Carone
*Assistant Examiner*—Gabriel Sukman
(74) *Attorney, Agent, or Firm*—Crowell & Moring LLP

(57) ABSTRACT

In the missile containing a predeterminate number of swing wings made of a flexible, resiliently elastic, substantially flat material, the substantially flat material contains a closed cavity. Pressurized as can be infed into the closed cavity from a pressurized gas source in the swung out condition of the swing wings. In one embodiment the substantially flat material of the swing wing directly forms the closed cavity. The substantially flat material is made of thin sheet of spring steel. The swing wings are connected at their base to the missile body via respective swivel joints. Each swivel joint comprises a pressurized as cartridge constituting the pressurized gas source for inflating the swing wing. Each swing wing contains two tongue-shaped members of the substantially flat material. The two tongue-shaped members have respective substantially straight base edges and substantially U-shaped external rim portions and are interconnected in the region of their external rim portions.

8 Claims, 2 Drawing Sheets

MISSILE

BACKGROUND OF THE INVENTION

The present invention relates to a new and improved construction of a missile.

In its more particular aspects, the present invention relates to a new and improved construction of a missile containing a predeterminate number of swing wings made of a flexible and resiliently elastic, substantially flat material.

Missiles are frequently disposed in a chamber defined by, for example, a dispenser. A high packing density is desirable in such arrangement. The walls which define the chamber are intended to encase the actual missile body or structure as closely as possible. However, the missiles have wings in the form of airfoils and guide or control surfaces. Such wings require space and thus counteract the realization of the desired high packing density. For this reason, the missiles have been provided with swing wings. The invention particularly relates to such missiles of the type containing swing wings.

There are also known guided projectiles which are fired in conventional manner from a weapon barrel. In such guided projectiles, guide or control surfaces are required for guidance which must be retracted during firing.

The term "missile" as used herein is intended to encompass missiles such as, for example, rockets which are equipped with inherent propulsion means, as well as ballistically flying projectiles of the type fired from a weapon barrel.

In a missile or projectile such as known, for example, from German Utility Model No. 8,428,118, an inwardly foldable wing is provided. Such wing contains two preferably domed wing blades which are interconnected at their wing tips. At their bases, the wing blades are mounted at respective supports. One of the supports comprises a hinge-type fixed bearing. The other support constitutes a hinge-type slide guide bearing. In the folded condition the wing blades are wrapped onto the circumference of the missile and immediately bear upon each other. The supports are placed closely adjacent each other in this folded condition. In their operative position the supports are spaced from each other so that the wing blades conjointly form a stiff, roof-shaped structure.

A similar guide unit Such as known, for example, from German Utility Model No. 8,615,207 contains unfoldable wings and is intended for projectiles and missiles. Each one of the wings is formed of two wing blades made of spring steel and interconnected at their wing tips. A base of one of the two wing blades is attached to a hinge-type fixed bearing and the base of the other wing blade is attached to a hinge-type slide guide bearing. In the inoperative condition the slide guide bearing is shifted close to the fixed bearing so that the two wing blades practically lie flat upon each other and can be bent around the projectile or missile. In the operative position and after departure from the weapon barrel or chamber, as the case may be, the slide guide bearing is displaced away from the fixed bearing in a groove which extends obliquely with respect to the circumferential direction of the projectile or missile. As a result, the two wing blades form a stiff, roof-like structure radially protruding from the projectile or missile.

Furthermore, German Utility Model Nos. 8,324,478 and 8,302,956 describe foldable wings or airfoils for ultra-lightweight aircraft. Such constructions cannot be used in connection with missiles for the purposes mentioned hereinbefore.

An aircraft or missile such as known, for example, from British Patent No. 1,024,103, is provided with a flexible wing or airfoil. Swing-out wing or airfoil spars are linked to the missile body or structure in this construction. Flexible web material extends between the wing or airfoil scars and the missile body or structure or fuselage. In the inoperative condition, the wing or airfoil spars are pivoted to the missile body or structure. In the operative condition, the wing or airfoil spars are pivoted into a swung-out position. The wing or airfoil spars, then, form a pair of delta wings conjointly with the flexible web material.

In a missile of the type as known, for example, from British Patent No. 2,059,023, spars which comprise rigid, hingedly interconnected members, are extended from a missile fuselage. The spars are covered on two of their sides by a fabric material forming a pocket. In the inoperative condition the spars inclusive of the fabric material are accommodated in the interior of the missile frame or fuselage.

The constructions according to the aforediscussed German Utility Models No. 8,428,118 and 8,615,207 require a complicated mechanism prone to malfunction and have only insufficient stability in their operative position. The arrangements according to British Patents No. 1,024,103 and 2,059,023 likewise require a complicated linkage which is subject to failure or malfunction. In these constructions, the wings are made of fabric or similar flexible material which is poorly suited for high flying speeds and high lateral accelerations.

SUMMARY OF THE INVENTION

Therefore, with the foregoing in mind it is a primary object of the present invention to provide a new and improved missile construction which is not afflicted with the drawbacks and limitations of the prior art constructions heretofore discussed.

Another and more specific object of the present invention is directed to the provision of a new and improved missile construction having comparatively simply constructed swing wings which can be swung out or extended in a simple manner and do not require for such extension complicated mechanisms which are subject to failure and malfunction.

A significant object of the present invention aims at providing a new and improved missile construction equipped with swing wings which, despite their simple construction and swing-out operation, have sufficient stability in their operative position and are also able to withstand high lateral accelerations.

Now in order to implement these and still further objects of the invention, which will become more readily apparent as the description proceeds, the missile of the present development is manifested, among other things, by the features that, (a) the substantially flat material contains a closed cavity, and (b) there is provided a pressure fluid source for infeeding pressure fluid into the closed cavity after extension or swing-out of the swing wings.

In this manner there is obtained a rigidified or reinforced swing wing which has sufficient stability also at high speeds and which does not require for its reinforcement the installation of a complicated mechanism prone to malfunction or failure due to jamming.

BRIEF DESCRIPTION OF THE DRAWINGS

The invention will be better understood and objects other than those set forth above, will become apparent when consideration is given to the following detailed description thereof. Such description makes reference to the annexed drawings wherein the same or analogous components are designated by the same reference characters and wherein.

DETAILED DESCRIPTION OF THE PREFERRED EMBODIMENTS

Figure 1:
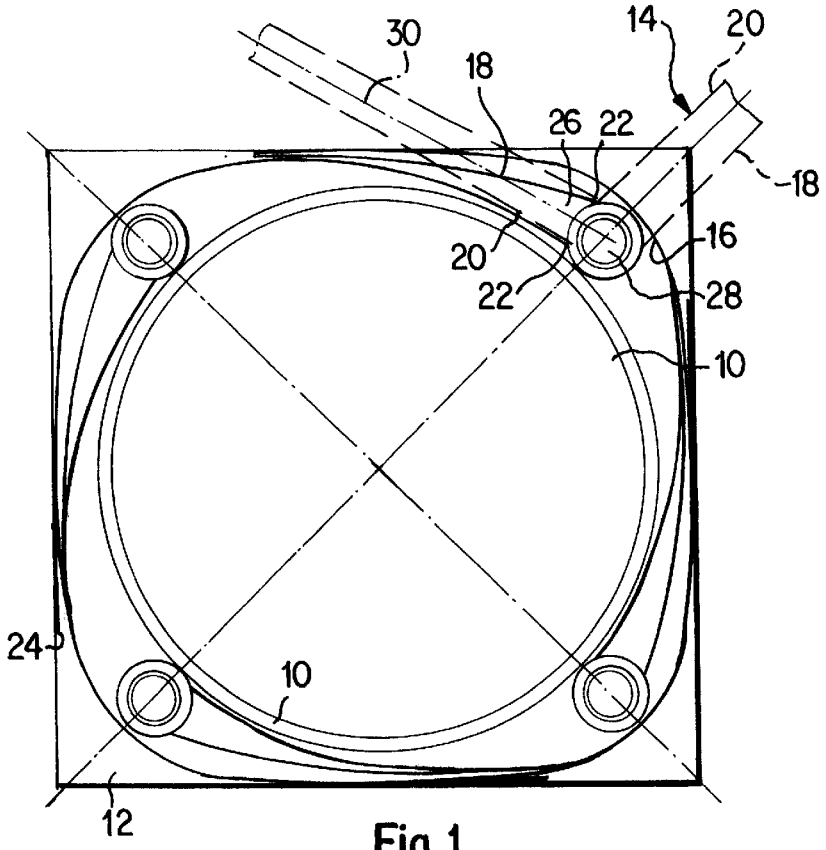
FIG. 1 a schematic cross-section through an exemplary embodiment of the inventive missile containing inwardly folded wings and located in a chamber of a dispenser.

Describing now the drawings, it is to be understood that only enough of the construction of the missile has been shown as needed for those skilled in the art to readily understand the underlying principles and concepts of the present development, while simplifying the showing of the drawings. Turning attention now specifically to FIGS. 1 and 2 of the drawings, there has been illustrated therein as a matter of explanation and not limitation an exemplary embodiment of the inventive projectile or missile having a missile body or structure 10. The missile is shown located within a chamber 12. The missile contains a predeterminate number of wings, in the illustrated example four wings 14 which are mutually angularly offset from each other by substantially 90 degrees. The wings 14 constitute swing wings and are connected to the missile body or structure 10 by means of respective swivel joints 16.

Each one of the wings or swing wings 14 comprises two tongue-shaped members 18 and 20 made of substantially flat material and having respective substantially straight base edges 22 and respective substantially U-shaped external rims or rim portions 24. The two tongue-shaped members 18 and 20 are interconnected at or in the region of their external rims or rim portions 24. At their respective base edges 22, the two tongue-shaped members 18 and 20 of substantially flat material are mounted in a spaced relationship to each other at a member of the swivel joint 16 and which swivel joint member is pivotably mounted relative to the missile body or structure 10.

The two tongue-shaped members 18 and 20 of substantially flat material are preferably made of thin sheet of spring steel. A closed cavity 26 is formed between the two tongue-shaped members 18 and 20 of substantially flat material and the swivel joint 16. A pressure fluid source 28 is arranged within the swivel joint 16. The pressure fluid source 28 may constitute a pressurized gas source, for example, a carbon dioxide cartridge. The pressurized gas source 28 can be connected to the closed cavity 26 which is formed between the two tongue-shaped members 18 and 20 of substantially flat material and the swivel joint 16, by means of not specifically illustrated controlled connecting means.

In their inoperative position, i.e. when the missile is located within the chamber 12, the wings or swing wings 14 are bent around the missile. The missile body or structure 10 has substantially circular cross-section. The chamber 12 is of substantially square cross-section and the swivel joints 16 are arranged in respective corners or corner regions of this chamber 12. The wings or swing wings 14, as illustrated in FIG. 1, are laterally pivoted or swung by means of the swivel joints 16 such as to extend substantially tangentially with respect to the missile body or structure 10, as shown by the broken line 30 in FIG. 1, and thereafter are resiliently elastically bent around the missile body or structure 10. In this arrangement, each one of the wings or swing wings 14 extends across the swivel joint 16 of an adjacent wing or swing wing 14 and around such adjacent wing or swing wing.

Upon departure of the missile from the chamber 12, the wings or swing wings 14 are extended or swung out as indicated at the top of FIG. 1 on the right-hand side thereof. Substantially at the same time, pressurized gas is infed into the closed cavity 26 from the pressure fluid or pressurized gas source 28. The closed cavity 26 is thereby pressurized and the associated wing or swing wing "inflated" so as to assume sufficient rigidity.

Figure 3:
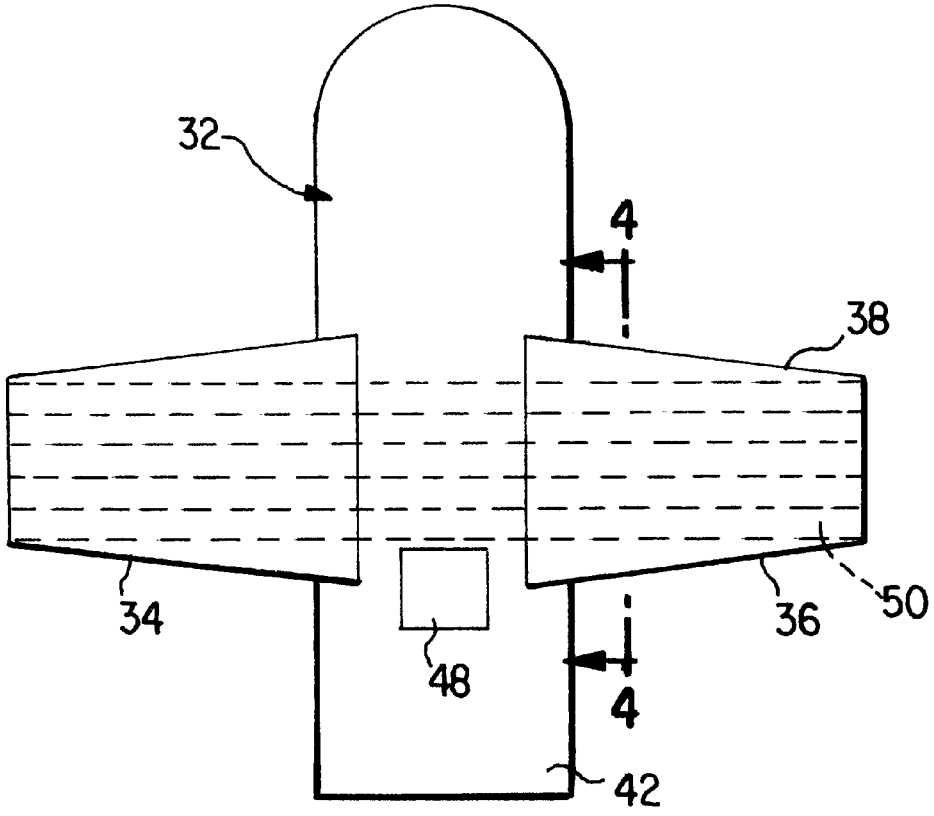
FIG. 3 is a top plan view of a further exemplary embodiment of the inventive missile having a modified construction and shows the wings in their swung-out position.
Figure 4:
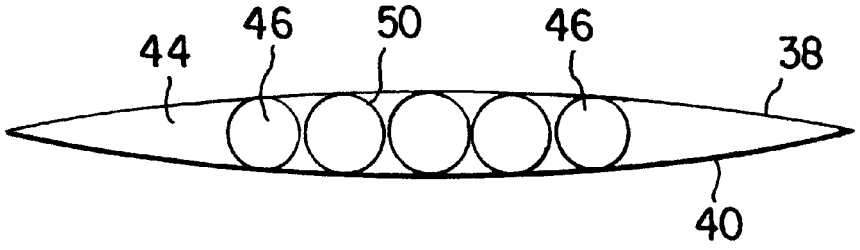
FIG. 4 is a section at an enlarged scale along the line A—A in FIG. 3.

In the modified exemplary embodiment of the inventive missile as shown in FIGS. 3 and 4, the reference character 32 designates a missile having wings or swing wings 34 and 36. Each one of the wings or swing wings 34 and 36 comprises two substantially trapezoidally shaped members 38 and 40 made of substantially flat material. The two members 38 and 40 of substantially flat material are respectively connected to a missile body or structure 42 of the missile 32 along or in the region of the long sides of their trapezoidal shape at a predeterminate spacing from each other; the two members 38 and 40 are interconnected at or in the region of the remaining sides of their trapezoidal shape.

Thus, each one of the wings or swing wings 34 and 36 defines a closed interior space 44. A plurality of cavities 46 is formed in each one of the interior spaces 44. Each one of the plurality of cavities 46, in turn, is formed of a flexible, gas-tight material arranged between the two substantially trapezoidally shaped members 38 and 40 of substantially flat material forming the associated wing or swing wing 34 or 36, as the case may be. A pressurized gas source 48 is provided for infeeding pressurized gas into the cavities 46. After infeeding the pressurized gas into the cavities 46, the inflated, flexible and gas-tight material constitutes a stiffening or reinforcement body for the associated wing or swing wing 34 or 36.

In the modified exemplary embodiment of the inventive missile according to FIGS. 3 and 4, each one of the cavities 46 is formed by a flexible plastic tube 50. The plastic tubes 50 extend radially away from the missile body or structure 42 between the respective two substantially trapezoidally shaped members 38 and 40 of substantially flat material and constitute reinforcing ribs therefore. The two substantially trapezoidally shaped members 38 and 40 of substantially flat material define the profile as well as the surface of each one of the wings or swing wings 34 and 36.

Figure 2:
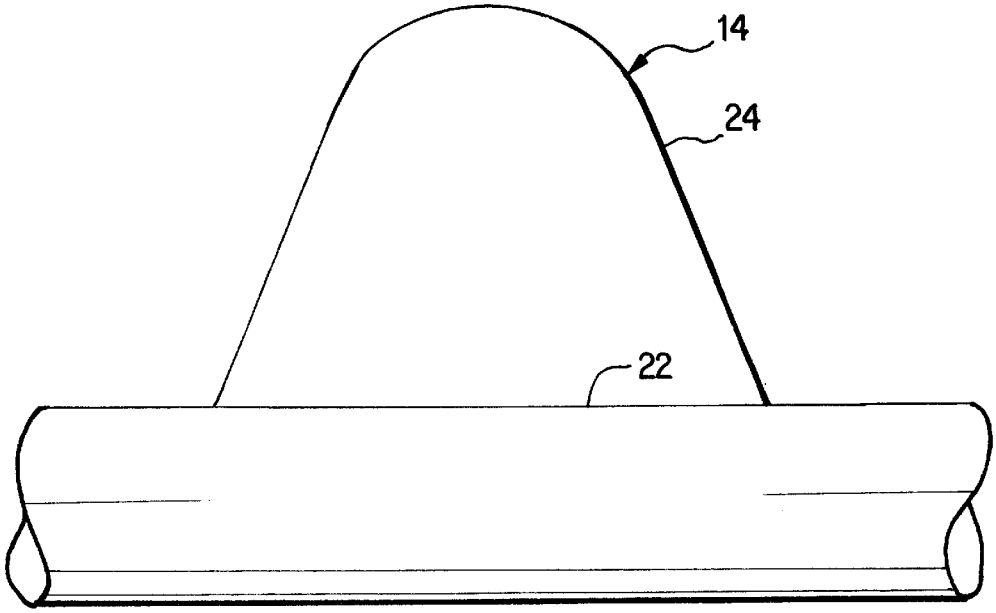
FIG. 2 is a schematic view of the inventive missile as shown in FIG. 1 with one wing in its operative position.

When the flexible plastic tubes 50 are not subjected to pressure, the wings or swing wings 34 and 36 can be bent around the missile body or structure 42, similar to the embodiment illustrated in FIGS. 1 and 2.

Plastic material of the type as sold under the Trademark KEVLAR can be used as the material for the flexible plastic tubes 50.

The pressure fluid may also constitute a pressurized liquid. Particularly, the pressure fluid may constitute a pressurized hardenable liquid plastic material which rapidly hardens after being infed into the cavity or cavities.

While there are shown and described present preferred embodiments of the invention, it is to be distinctly understood that the invention is not limited thereto, but may be otherwise variously embodied and practiced within the scope of the following claims. Accordingly,

What is claimed is:

1. A missile comprising:

a predeterminate number of swing wings made of flexible and resiliently elastic, substantially flat material, said substantially flat material being constituted of a thin sheet of spring steel;

said substantially flat material of each one of said predeterminate number of swing wings containing a closed cavity;

a pressure fluid source; and said pressure fluid source being connected to said closed cavity for infeeding pressure fluid into said cavity in a swung-out condition of an associated swing wing.

2. The missile as defined in claim 1, wherein:

said closed cavity is directly formed by the substantially flat material of said associated swing wing.

3. The missile as defined in claim 1, further including:

a body of flexible gas-tight material defining said closed cavity;

each one of said predeterminate number of swing wings containing two members formed of said substantially flat material;

said body of flexible gas-tight material being arranged between said two members of the substantially flat material forming the associated swing wing;

said pressure fluid source constituting a source of pressurized gas; and said body of flexible gas-tight material, conjointly with said pressurized gas infed into said closed cavity, constituting a reinforcement body for said associated swing wing.

4. The missile as defined in claim 1, further including:

a missile body;

each one of said predeterminate number of swing wings having a base; and a swivel joint connecting said base of the associated swing wing to said missile body.

5. The missile as defined in claim 4, further including:

a pressurized gas cartridge constituting a pressure fluid source for infeeding pressurized gas into the cavity of an associated one of said predeterminate number of swing wings; and said swivel joint containing said pressurized gas cartridge.

6. The missile as defined in claim 2, wherein:

each one of said predeterminate number of swing wings comprises:

two tongue-shaped members made of said substantially flat material;

each one of said two tongue-shaped members having a substantially straight base edge;

each one of said two tongue-shaped members defining a substantially U-shaped external rim portion; and said two tongue-shaped members being interconnected in the region of their external rim portions.

7. A missile comprising:

a predeterminate number of swing wings made of flexible and resiliently elastic, substantially flat material;

said substantially flat material of each one of said predeterminate number of swing wings containing a closed cavity;

each one of said predeterminate number of swing wings comprises two members made of said substantially flat material;

each one of said two members defining a rim portion;

said two members being interconnected in the region of their rim portions;

said missile defining a radial direction extending radially relative to said missile;

a plurality of plastic tubes arranged in said radial direction of said missile between said two members of an associated swing wing;

said plurality of plastic tubes constituting the closed cavity of the associated swing wing;

each one of said plurality of plastic tubes constituting, in its inflated state, a reinforcing rib of said associated swing wing;

a pressure fluid source; and said pressure fluid source being connected to said closed cavity for infeeding pressure fluid into said cavity in a swung-out condition of an associated swing wing.

8. The missile as defined in claim 1, wherein:

said pressure fluid outfed from said pressure fluid source comprises a pressurized hardenable liquid plastic material; and said liquid plastic material rapidly hardening after being infed into said closed cavity.

* * * * *